US008328528B2

(12) United States Patent
Fisher

(10) Patent No.: US 8,328,528 B2
(45) Date of Patent: Dec. 11, 2012

(54) DOUBLE STANDING VALVE SUCKER ROD PUMP

(75) Inventor: Charles Gene Fisher, Okemah, OK (US)

(73) Assignee: Thompson Pump Company, Okmulgee, OK (US)

( * ) Notice: Subject to any disclaimer, the term of this patent is extended or adjusted under 35 U.S.C. 154(b) by 0 days.

(21) Appl. No.: 13/206,101

(22) Filed: Aug. 9, 2011

(65) Prior Publication Data

US 2011/0293440 A1 Dec. 1, 2011

Related U.S. Application Data

(62) Division of application No. 12/391,560, filed on Feb. 24, 2009, now Pat. No. 8,192,181.

(51) Int. Cl.
*F04B 49/22* (2006.01)

(52) U.S. Cl. ..... 417/53; 417/456; 417/555.2

(58) Field of Classification Search ..... 417/555.2, 417/435, 434, 440, 296, 306
See application file for complete search history.

(56) References Cited

U.S. PATENT DOCUMENTS 3,653,717 A 4/1972 Rich et al.
3,861,471 A 1/1975 Douglas
4,243,361 A 1/1981 Groff
5,593,289 A 1/1997 Tarpley
6,196,312 B1 3/2001 Collins et al.
6,361,272 B1 3/2002 Bassett
6,537,042 B1 3/2003 Lundback
6,945,762 B2 9/2005 Williams
6,948,917 B1 9/2005 Carrens
7,108,059 B1 9/2006 Lanier
7,380,608 B2 6/2008 Geier
7,413,009 B2 8/2008 Jacobs et al.
2002/0076343 A1 6/2002 Spears

*Primary Examiner* — Anh Mai
*Assistant Examiner* — Brenitra M Lee
(74) *Attorney, Agent, or Firm* — Molly D. McKay

(57) ABSTRACT

A sucker rod pump with no travelling valve consisting of, from the bottom: hold down with pump inlet, lower standing valve, hollow coupling, upper standing valve suspended within the coupling, relief valve, hollow pump housing, solid piston within the housing, and barrel to clean and retain the piston in the housing. The piston attaches to and reciprocating with the rod string. Peripheral channels in the relief valve communicate between the coupling and the housing. A central channel in the relief valve communicates between the upper standing valve and the pump's outlets. The upstroke pulls fluid from the bottom of the well upward through the open lower standing valve, around the closed upper standing valve and into the housing chamber. The down stroke pushes fluid from the housing chamber past the closed lower standing valve and through the open upper standing valve to the pump's exit into the tubing.

8 Claims, 6 Drawing Sheets

DOUBLE STANDING VALVE SUCKER ROD PUMP

CROSS-REFERENCE TO RELATED APPLICATIONS

The present application is a divisional application of U.S. patent application Ser. No. 12/391,560 for the invention entitled Double Standing Valve Sucker Rod Pump which was filed on Feb. 24, 2009 now U.S. Pat. No. 8,192,181.

BACKGROUND OF THE INVENTION

1. Field of the Invention

The present invention is a sucker rod pump that employs double standing valves and does not have a traveling valve. Specifically the present pump is particularly suited for use in gas producing coal bed wells to pump off excess water from the well so that gas can be produced, although the pump is not limited to this use.

2. Description of the Related Art

Gas producing coal bed wells also produce water. This water must be removed from the wells so that the wells can continue to produce gas. Prior art pumps that are employed to remove this water from the wells utilize a combination of a standing valve and a traveling valve. The standing valve attaches to the tubing via a hold down device provided on the pump that engages a seating shoe on the tubing. Thus the standing valve remains stationary at the bottom of the well while in service. The traveling valve is attached to the rod string and moves in a reciprocating manner at the bottom of the well in conjunction with the up and down movement of the rod string. The water in the coal bed wells contains fine particles of coal that tend to clog the valves of these prior art pumps.

The present invention addresses this problem by providing a pump that has two standing valves and no traveling valve. The two standing valves are less likely to be fouled by fine particles of coal than the prior art pumps employing a combination of a traveling valve and a standing valve.

Another shortcoming of prior art sucker rod pumps is that they tend to gas lock. This is due in large part to the fact that, as the travelling valve moves upward in the well, the traveling valve moves a considerable distance away from the standing valve, creating a large fluid chamber between the two valves where gas can accumulate and cause the pump to gas lock. The present invention addresses this problem by maintaining its two standing valves in close proximity to each other and having the chamber where fluid accumulates located above both of the two standing valves.

Further, prior art sucker rod pumps function by pulling or lifting the fluid from the bottom of the well in association with the upstroke of the rod string. This means that the motor that moves the rod up and down in the well must work hard to lift the weight of both the rod string and the fluid column that is being pumped to the surface.

The present invention addresses this shortcoming by using the weight of the rod string to push the fluid to the top in association with the down stroke of the rod. When the rod string is lifted with the present invention, the motor that moves the rod up and down in the well only lifts the weight of the rod string, and not the weight of the fluid column that is being pumped to the surface. By using the weight of the rod string to push the fluid to the surface of the well, this creates less strain on the motor. Also because the motor is not working as hard, less energy is needed to pump the fluid to the top of the well, resulting in energy savings.

The present invention is a specialized pump for the coal bed gas fields that helps pump the fluid off the well to let the gas flow. Most of these wells will produce coal dust that will pack and bind up a conventional pump. The design of this pump will keep the piston from sticking. As the piston is a solid rod and pushes the fluid to the surface, there is much less work for the unit to do since it uses the weight of the rod string to push the fluid, rather than lifting the fluid with the rod string. The motor only uses power to lift the rod string. On the upstroke, the housing fills with fluid and on the down stroke, the fluid is pushed out a bottom discharging valve, keeping the seating assembly from sanding in. The barrel of this pump has a beveled wiping edge on its upper end to keep the piston rod free from coal dust as it strokes. The barrel is short and the length of the stroke is adjusted with the length of the housing. With the shorter barrel, there is less area inside to bind. This makes it less expensive to repair. The wearing parts inside the barrel are smaller, thereby saving on the cost of spare parts. This pump will provide greater savings on downtime and repair than a common down hole pump. This cost savings will offset the slightly higher initial cost of this pump. The pump can be installed with any conventional hold down assembly. With improved materials such as carbide or ceramic valves and nickel carbide barrel, the pump will provide for long and profitable runs on wells.

SUMMARY OF THE INVENTION

Prior art pumps that are employed to remove water from gas producing coal bed wells utilize a combination of a standing valve and a traveling valve. The standing valve attaches to the tubing via a hold down device provided on the pump that engages a seating shoe on the tubing. Thus the standing valve remains stationary at the bottom of the well while in service. The traveling valve is attached to the rod string and moves in a reciprocating manner at the bottom of the well in conjunction with the up and down movement of the rod string.

During upstroke of the rod string, the standing valve of prior art pumps opens and the traveling valve closes to allow fluid to enter into the pump chamber located between the standing valve and the traveling valve. Then during down stroke of the rod string, the standing valve closes and the traveling valve opens forcing the fluid that is in the hollow rod or pump chamber to travel through the traveling valve and be force into the tubing above the seating shoe. Successive repetitions of the upstroke and down stroke of the rod string force more and more fluid into the tubing. Because the fluid can only move upward, it flows to the surface of the well within the tubing where it is removed from the well. These prior art pumps suffer from several shortcomings, including the tendency to clog up with particulate matter and to gas lock.

The present invention is a double standing valve sucker rod pump that is particularly suited for use in gas producing coal bed wells to remove the water from the wells so the wells can continue to produce gas. However, this pump is not limited to this application and can be used for a variety of fluid pumping applications. This pump differs from prior art sucker rod pumps in that it does not have a traveling valve, but rather employs two standing valves to pump fluid up through the well tubing from the bottom of the well to the surface.

The pump is removably secured to the bottom of the well by a hold down that is attached at the bottom of the pump that removably engages a seating shoe provided on the tubing. The seating shoe and the hold down seal the pump to the tubing and prevent fluid at the bottom of the well from flowing into the interior tubing space between the rod sting and the tubing unless it is pumped into that interior tubing space by the pump. The hold down is hollow and is provided at its lower end with an inlet for the pump. The lower end of the hold down is threaded so that an optional filter or strainer can be attached thereto to prevent large particles from entering the pump. The hold down is attached on its upper end to a lower end of a lower standing valve.

An upper end of the lower standing valve is secured to a hollow coupling which houses an upper standing valve that extends downward into the hollow interior coupling chamber of the coupling. An upper end of the coupling attaches to a lower end of a relief valve. An upper end of the relief valve attaches to a lower end of the pump housing. An upper end of the housing is attached to a lower end of a pump barrel.

The relief valve is provided with peripheral channels there through that allow fluid to flow from between the interior coupling chamber of the coupling and a housing chamber located within the hollow housing of the pump. The relief valve is also provided with a central channel there through that allows fluid to flow from the upper standing valve to side openings in the relief valve that serve as the outlets of the pump.

A movable piston of the pump is attached at the bottom of the rod string and reciprocates up and down in the pump housing in conjunction with the up and down movement of the rod string. The piston consists of a piston rod that attaches to the rod string on its upper end and is provided with an enlarged piston cap on its lower end. The piston cap is larger in diameter than the barrel and is held within the housing by the barrel. The barrel is provided with a beveled upper opening that serves to clean the piston rod as the piston reciprocates within the barrel and housing. The reciprocating action of the piston serves to pull fluid upward into the fluid chamber within the housing on the upstroke of the piston and serves to push fluids to the surface of the well on the down stroke of the piston by forcing the fluid to pass through the upper standing valve.

The lower valve consists of a lower seat, a lower ball, and a lower barrel cage that houses the lower seat and lower ball and retains the lower ball within the lower standing valve. The lower standing valve is opened when pressure below the lower ball is greater than pressure above the lower ball and, alternately, is closed when pressure above the lower ball is greater than pressure below the lower ball. During upstroke of the piston, the lower ball is open; during down stroke of the piston, the lower ball is closed.

The upper standing valve attaches to a threaded lower end of the relief valve located internally within the coupling. The upper standing valve attaches to the threaded lower end of the relief valve via an upper barrel cage which houses an upper seat and upper ball that are held in place by a hollow seat plug. Similar to the lower standing valve, the upper standing valve is opened when pressure below the upper ball is greater than pressure above the upper ball and is alternately closed when pressure above the upper ball is greater than pressure below the upper ball. But opposite the positions of the lower standing valve, during upstroke of the piston, the upper ball is closed and during upstroke of the piston, the upper ball is open.

The flow of fluid through the pump will now be described. During upstroke of the piston, the lower standing valve is open and the upper standing valve is closed. Thus, during upstroke of the piston, fluid flows upward into the lower end of the lower standing valve via the hollow hold down, then up through the lower seat and around the lower ball, then through the lower barrel cage before exiting the lower standing valve at its upper end and entering the hollow coupling chamber.

The upper standing valve is closed so that fluid that enters the coupling chamber, flows around the outside of the upper standing valve, passes through the peripheral channels in the relief valve and enters into the housing chamber of the pump, filling the housing chamber with fluid.

When the piston has finished its upward stroke, it reversed direction and begins its downward stroke. As the piston begins to move downward, the lower ball closes on the lower seat, thereby closing the lower standing valve. Simultaneously, the upper ball is lifted off of the upper seat and thereby opens the upper standing valve. As the piston continues to move downward, the fluid contained within the housing chamber flows back down through the peripheral channels in the relief valve and back into the coupling chamber. Because the lower standing valve is closed, the fluid reverses direction within the coupling chamber and flows upward into the open end of the seat plug and into the open upper standing valve. The fluid flows up through the upper seat and around the upper ball, then through the upper barrel cage before exiting the upper standing valve at its upper end and entering the central channel of the relief valve. The central channel of the relief valve is in fluid communication with side openings in the relief valve which serve as the outlets for the pump. The fluid flows out of the side openings and into the interior tubing space above the seating shoe and between the rod string and the tubing. Successive strokes of the piston force more and more fluid through the outlets and into the interior of the tubing. Because the fluid can only move upward, it flows to the surface of the well within the tubing where it is removed from the well.

This pump does not have a hollow plunger rod like prior art pumps and includes a barrel attached at the top of the pump to secure the piston to the pump which is not employed in prior art pumps.

DETAILED DESCRIPTION OF THE PREFERRED EMBODIMENT

Figure 1:
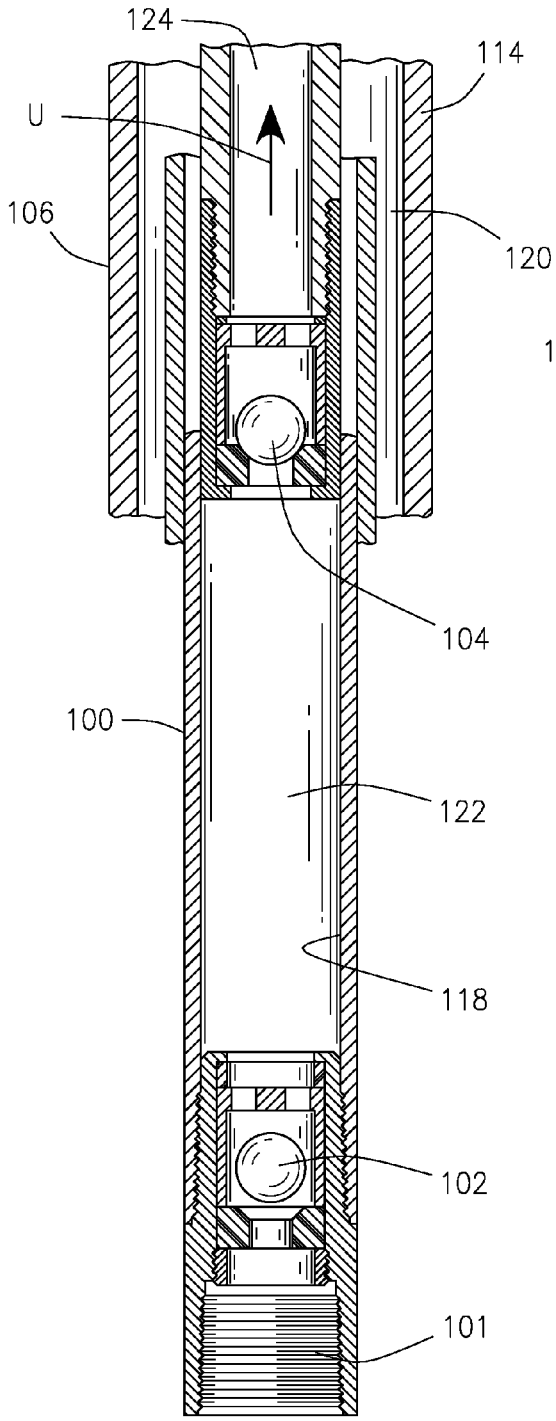
FIG. 1 PRIOR ART
FIG. 1 is a partially cut away view of a prior art pump shown in the upstroke of the rod string with the standing valve open and the travelling valve closed.
Figure 2:
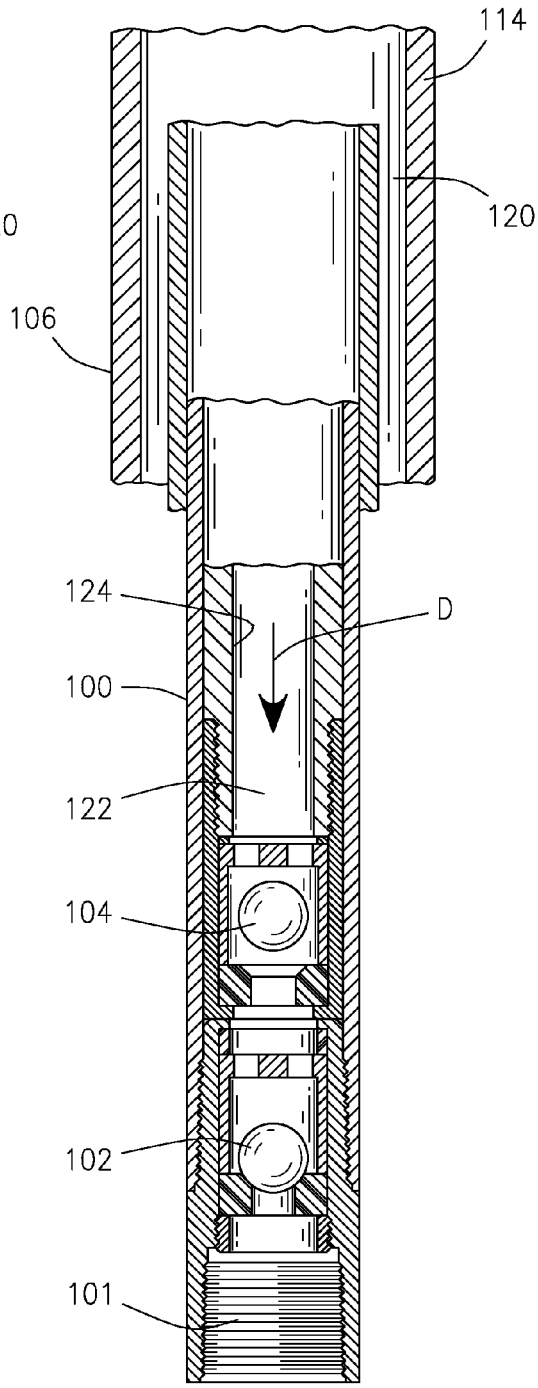
FIG. 2 PRIOR ART
FIG. 2 is a partially cut away view of the prior art pump of FIG. 1 shown in the down stroke of the rod string with the standing valve closed and the travelling valve open.

Referring initially to FIGS. 1 and 2, prior art pumps 100 that are employed to remove water 122 from gas producing coal bed wells 114 utilize a combination of a standing valve 102 and a traveling valve 104. Hereafter water 122 will be generically referred to as fluid 122.

Figure 7:
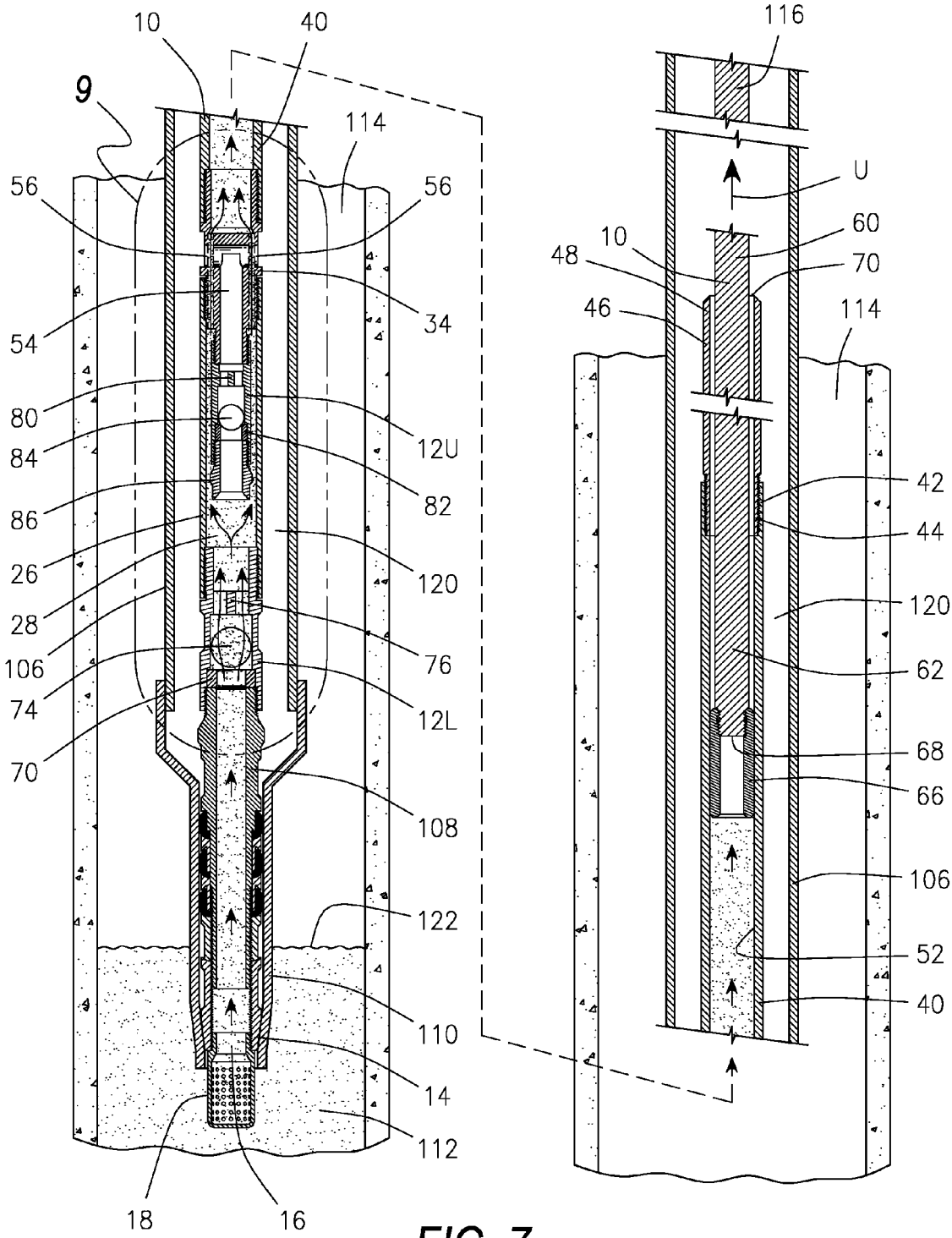
FIG. 7 is a cut away view of the double standing valve sucker rod pump of FIG. 3 shown installed in a well and showing the flow of fluid through the pump when the piston is in down stroke mode.
Figure 8:
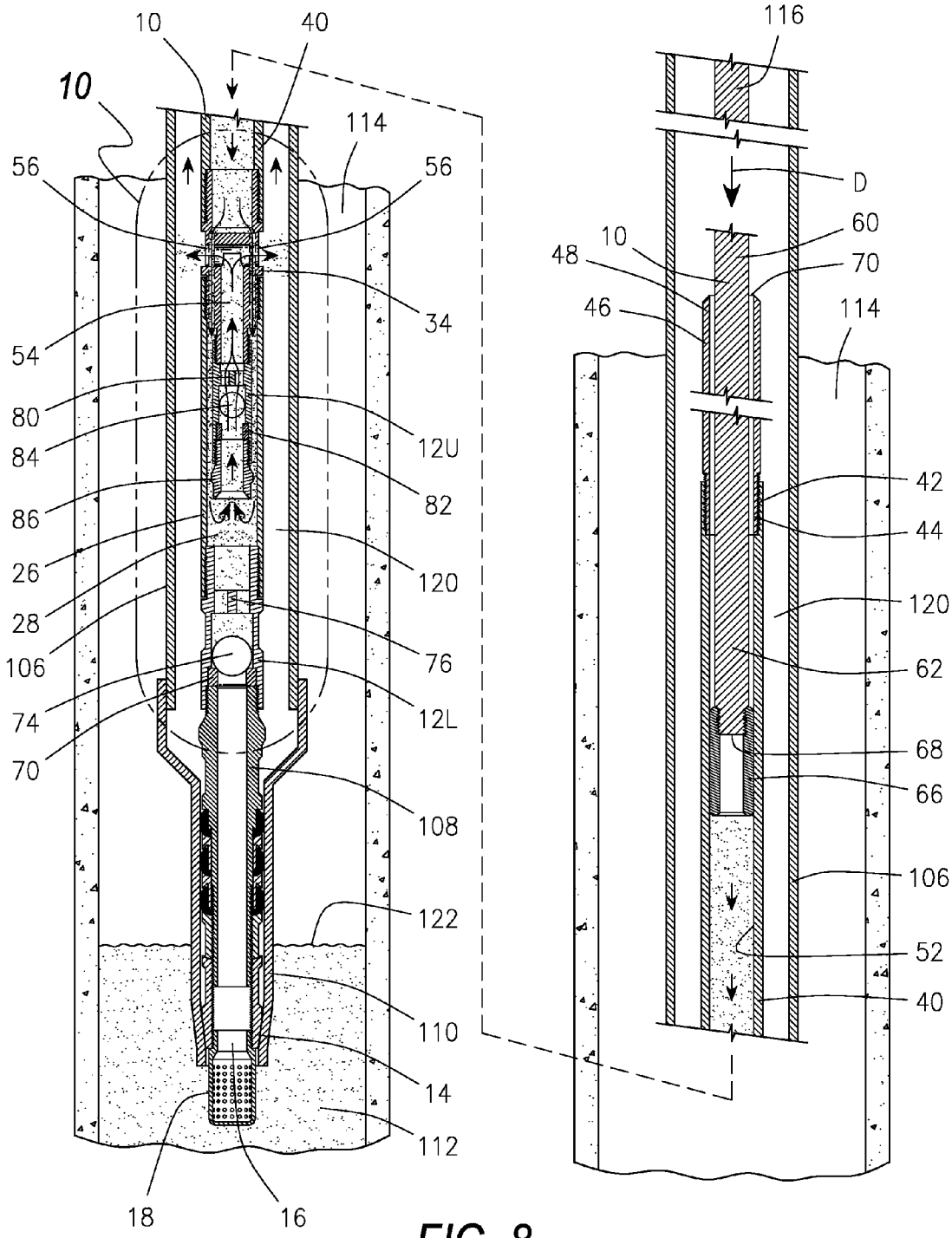
FIG. 8 is a cut away view of the double standing valve sucker rod pump of FIG. 7 shown installed in a well and showing the flow of fluid through the pump when the piston is in upstroke mode.

Although not illustrated in FIGS. 1 and 2, a hold down device 108 similar to the one illustrated in FIGS. 7 and 8 threads to the bottom 101 of the standing valve 102 of the prior art pump 100. The hold down device 108 secures the prior art pump 100 to the well tubing 106 by removably engaging a seating shoe 110 provided on the tubing 106. Thus the standing valve 102 remains stationary at the bottom 112 of the well 114 while in service.

Referring again to FIGS. 1 and 2 in conjunction with FIGS. 7 and 8, the traveling valve 104 of the prior art pump 100 attaches to the rod string 116 and moves in a reciprocating manner at the bottom 112 of the well 114 in conjunction with the up and down movement of the rod string 116.

Referring specifically to FIG. 1, during upstroke of the rod string 116, as indicated by the arrow U, the standing valve 102 of prior art pumps 100 opens and the traveling valve 104 closes to allow fluid 122 to enter into a pump chamber 118 located between the standing valve 102 and the traveling valve 104.

Now referring to FIG. 2, during down stroke of the rod string 116, as indicated by Arrow D, the standing valve 102 closes and the traveling valve 104 opens, thereby forcing the fluid 122 that is in the pump chamber 118 to travel through the traveling valve 104 and be forced into a fluid chamber 124 of the pump 100 that is located above the traveling valve 104. Although not illustrated, this fluid chamber 124 opens to the interior tubing space 120. The interior tubing space 120 is external to and surrounds the pump 100 and the rod string 116 and is located internally or within the tubing 106 and extends from the seating shoe 110 upward to the surface of the well 114.

When the next upstroke of the rod string 116 occurs, the fluid 122 that is now located within the fluid chamber 124 must be raised along with the rod string 116 and the traveling valve 104 in order to pump the fluid to the surface. During the upstroke, the rod string 116 has the weight of the fluid 122 that is located within the fluid chamber 124 and the weight of the entire fluid column located within the interior tubing space 120 pushing downward on the rod string 116. Thus, the rod string 116 has a huge weight that it has to lift on each upstroke.

Successive repetitions of the upstroke and down stroke of the rod string 116 force more and more fluid 122 into the interior tubing space 120 of tubing 106. Because the fluid 122 can only move upward, it flows to the surface of the well 114 within the tubing 106 where it is removed from the well 114. In addition to the energy and strain on the equipment required to pump the fluid 122 to the surface with these prior art pumps 100, they also suffer from several other shortcomings, including the tendency to clog up with particulate matter and to gas lock.

Figure 3:
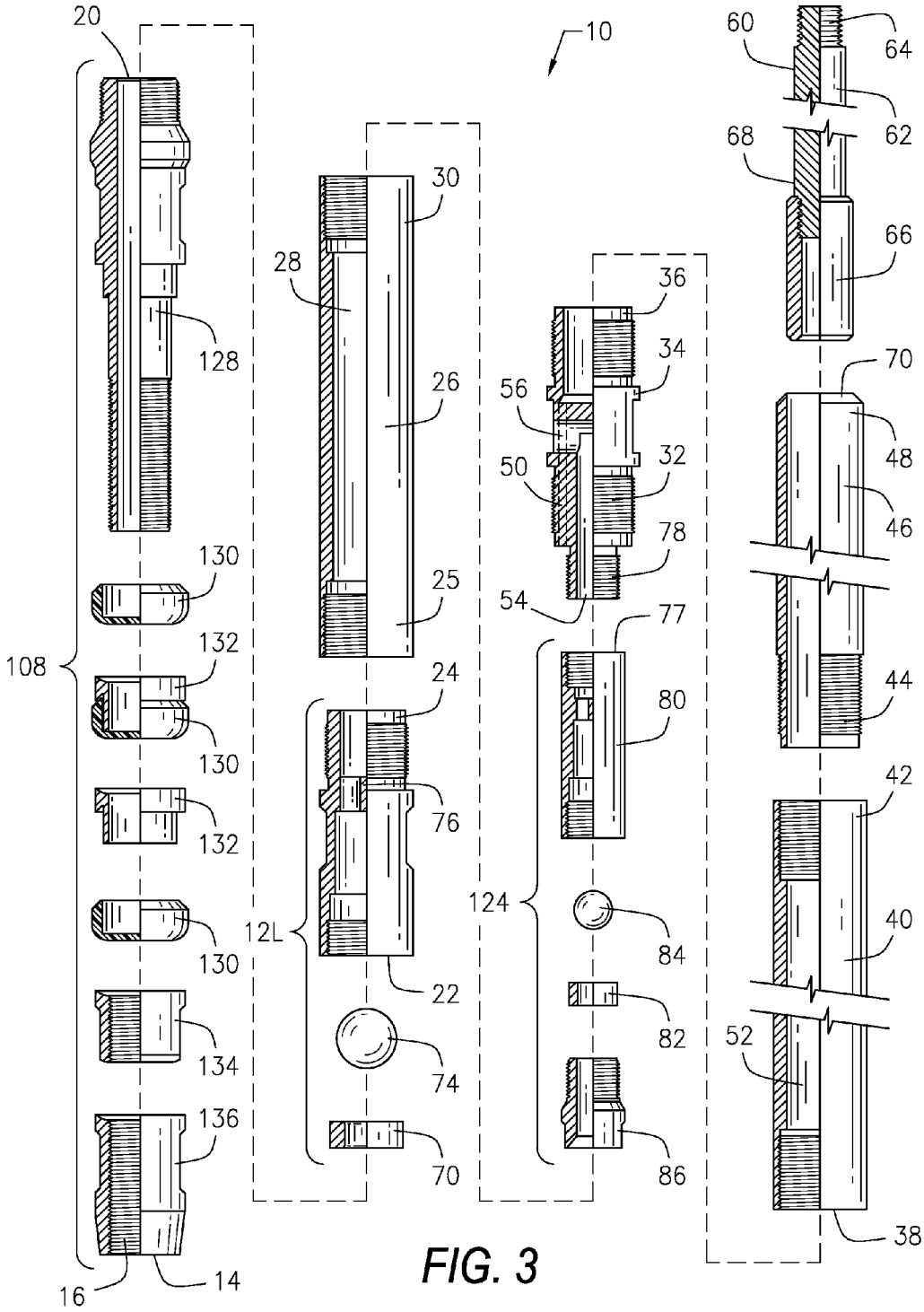
FIG. 3 is an exploded view of a double standing valve sucker rod pump constructed in accordance with a preferred embodiment of the present invention with each piece shown in partial cut away.

Referring now to FIGS. 3, 7 and 8, there is illustrated a double standing valve sucker rod pump 10 constructed in accordance with a preferred embodiment of the present invention. The pump 10 is particularly suited for use in gas producing coal bed wells 114 to remove the water 122 from the wells 114 so the wells 114 can continue to produce gas. However, this pump 10 is not limited to this application and can be used for a variety of fluid pumping applications. This pump 10 differs from prior art sucker rod pumps 100 in that it does not have a traveling valve 104, but rather employs two standing valves 12L and 12U to pump fluid 122 up through the interior tubing space 120 of the well tubing 106 from the bottom 112 of the well 114 to the surface.

As illustrated in FIGS. 7 and 8, the pump 10 is removably secured to the bottom 112 of the well 114 by a hold down 108 attached at the bottom of the pump 10 that removably engages a seating shoe 110 provided on the tubing 106. Jointly, the seating shoe 110 and the hold down 108 seal the pump 10 to the tubing 106 and prevent fluid 122 at the bottom 112 of the well 114 from flowing into the interior tubing space 120 located above the seating shoe 110 and between the rod sting 116 and the tubing 106 unless it is pumped into that interior tubing space 120 by the pump 10.

Referring now also to FIG. 3, the hold down 108 is hollow and is provided at its lower end 14 with an inlet 16 for the pump 10. The lower end 14 of the hold down 108 is threaded so that an optional filter or strainer 18 can be attached thereto to prevent large particles from entering the pump 10. The hold down 108 is attached on its upper end 20 to a lower end 22 of a lower standing valve 12L. A typical hold down 108 is illustrated in FIG. 3 and shown as several individual pieces that are held together by threads. Those pieces typically are a body 128, seals 130, spacers 132, a seal retaining ring 134 and a seating nipple 136.

An upper end 24 of the lower standing valve 12L is secured to a lower end 25 of a hollow coupling 26. The hollow coupling 26 houses the upper standing valve 12U that extends downward into a hollow interior coupling chamber 28 located with the coupling 26. An upper end 30 of the coupling 26 attaches to a lower end 32 of a relief valve 34. An upper end 36 of the relief valve 34 attaches to a lower end 38 of the pump housing 40. An upper end 42 of the housing 40 is attached to a lower end 44 of a pump barrel 46. An upper end 48 of the pump barrel 46 is freestanding within the well 114, supported by the hold down 108.

Figure 4:
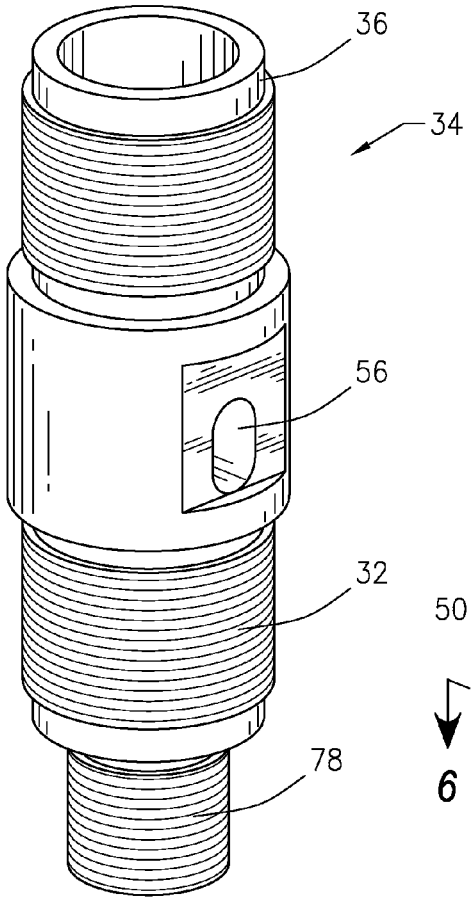
FIG. 4 is an enlarged perspective view of the relief valve of FIG. 3.
Figure 5:
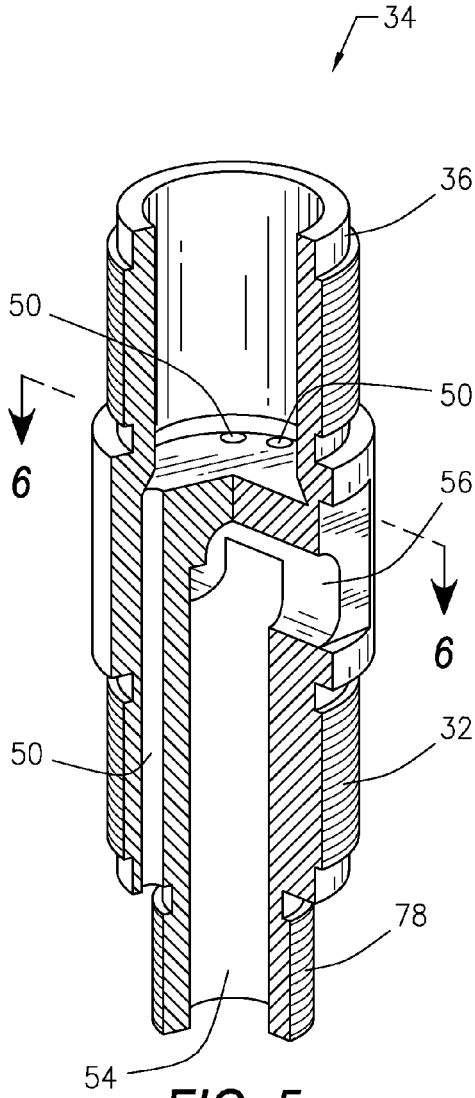
FIG. 5 is a partially cut away view of the relief valve of FIG. 4.
Figure 6:
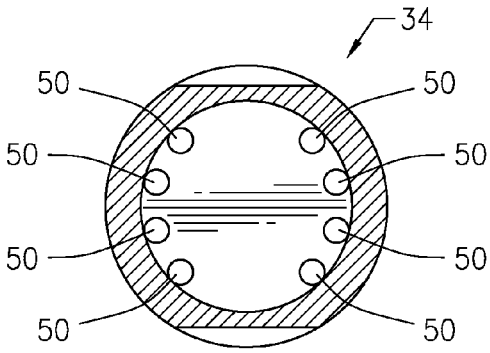
FIG. 6 is a cross sectional view of the relief valve taken along line 6-6 of FIG. 5.

Referring to FIGS. 4, 5, and 6, the relief valve 34 is provided with a plurality of peripheral channels 50 that extend longitudinal through the relief valve 34. The peripheral channels 50 allow fluid 122 to flow freely back and forth between the interior coupling chamber 28 of the coupling 26 located below the relief valve 34 and a housing chamber 52 provided within the hollow housing 40 of the pump 10 which is located above the relief valve 34.

The relief valve 34 is also provided with a central channel 54 that extends from the lower end 32 of relief valve 34 longitudinally upward partially through the relief valve 34. The central channel 54 is in fluid communication with two side openings 56 provided in the relief valve 34 so that fluid 122 that flows from the upper standing valve 12U and through the central channel 54 exits the pump via the relief valve's side openings 56. The side openings 56 are in fluid communication with the interior tubing space 120 and serve as outlets 56 of the pump 10.

A movable piston 60 of the pump 10 is attached at the bottom of the rod string 116 and reciprocates up and down in the pump housing 40 in conjunction with the up and down movement of the rod string 116. The piston 60 consists of a piston rod 62 that attaches to the rod string 116 via an upper end 64 of the piston rod 62 and an enlarged piston cap 66 attached to a lower end 68 of the piston rod 62. The piston cap 66 is larger in diameter than the barrel 46 so that the piston cap 66 is held within the housing chamber 52 by the barrel 46. The barrel 46 is provided with a beveled upper opening 70 within which the piston rod 62 reciprocates. The beveled upper opening 70 serves to clean the piston rod 62 as the piston 60 reciprocates within the barrel 46 and housing 40. Because of the tight clearance between the piston cap 66 and the housing 40, the reciprocating action of the piston 60 within the housing chamber 52 serves to pull fluid 122 upward into the housing chamber 52 on the upstroke of the piston 60. Also, the reciprocating action of the piston 60 serves to push fluid 122 to the surface of the well 114 on the down stroke of the piston 60 by forcing the fluid 122 to pass through the upper standing valve 12U. The pump 10 uses the downward stroke and the weight of the rod string 116 to push the fluid 122 to the surface of the well 114 instead of lifting the fluid 122 in the manner of prior art pumps 100.

Referring now to FIG. 3, the lower standing valve 12L consists of a lower seat 72, a lower ball 74, and a lower barrel cage 76 that houses the lower seat 72 and lower ball 74 and retains the lower ball 74 within the lower standing valve 12L. The lower standing valve 12L is opened when pressure below the lower ball 74 is greater than pressure above the lower ball 74. Alternately, the lower standing valve 12L is closed when pressure above the lower ball 74 is greater than pressure below the lower ball 74. During upstroke of the piston 60, the lower ball 74 is open. During down stroke of the piston 60, the lower ball 74 is closed.

Continuing to refer to FIG. 3, an upper end 77 of the upper standing valve 12U attaches to a centrally located threaded lower end 78 of the relief valve 34 located internally within the coupling 26. The upper standing valve 12U attaches to the centrally located threaded lower end 78 of the relief valve 34 via an upper barrel cage 80 which houses an upper seat 82 and upper ball 84 that are held in place by a hollow seat plug 86. Similar to the lower standing valve 12L, the upper standing valve 12U is opened when pressure below the upper ball 84 is greater than pressure above the upper ball 84 and is alternately closed when pressure above the upper ball 84 is greater than pressure below the upper ball 84. During upstroke of the piston 60, the upper ball 84 is closed and during upstroke of the piston 60, the upper ball 60 is open. Thus, when the lower standing valve 12L is open, the upper standing valve 12U is closed. Likewise, when the lower standing valve 12L is closed, the upper standing valve 12U is open.

Figure 9:
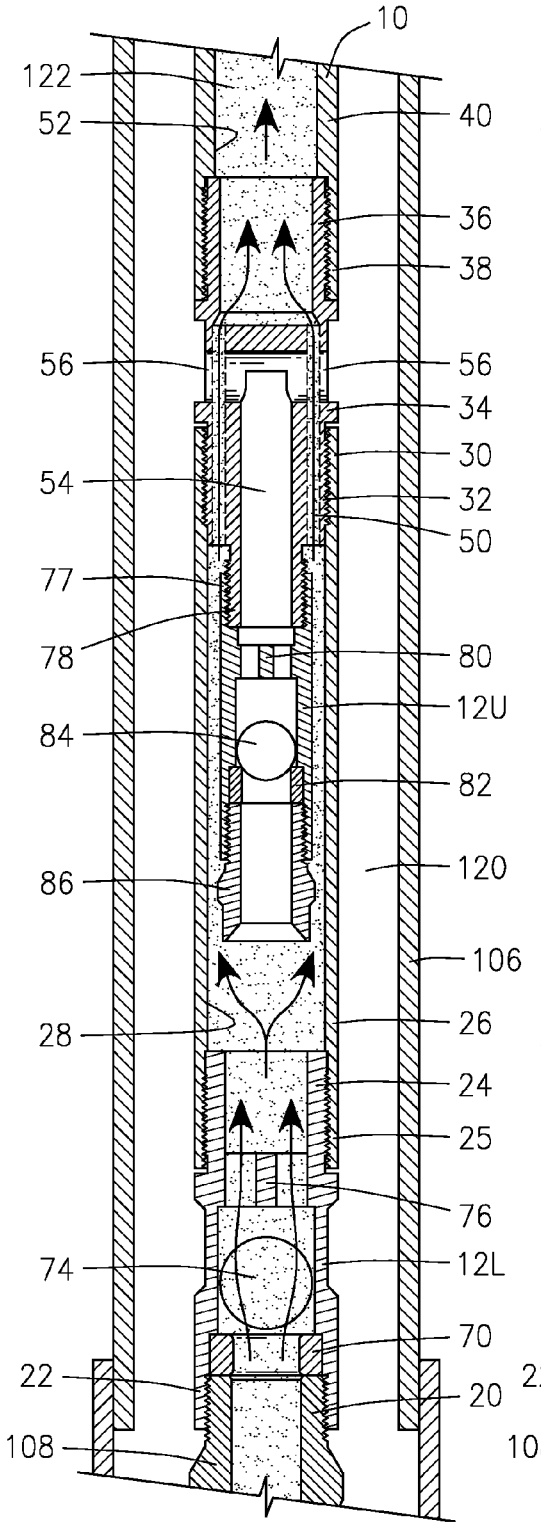
FIG. 9 is an enlarged cut away view of that portion of the pump of FIG. 7 shown within circle 9.
Figure 10:
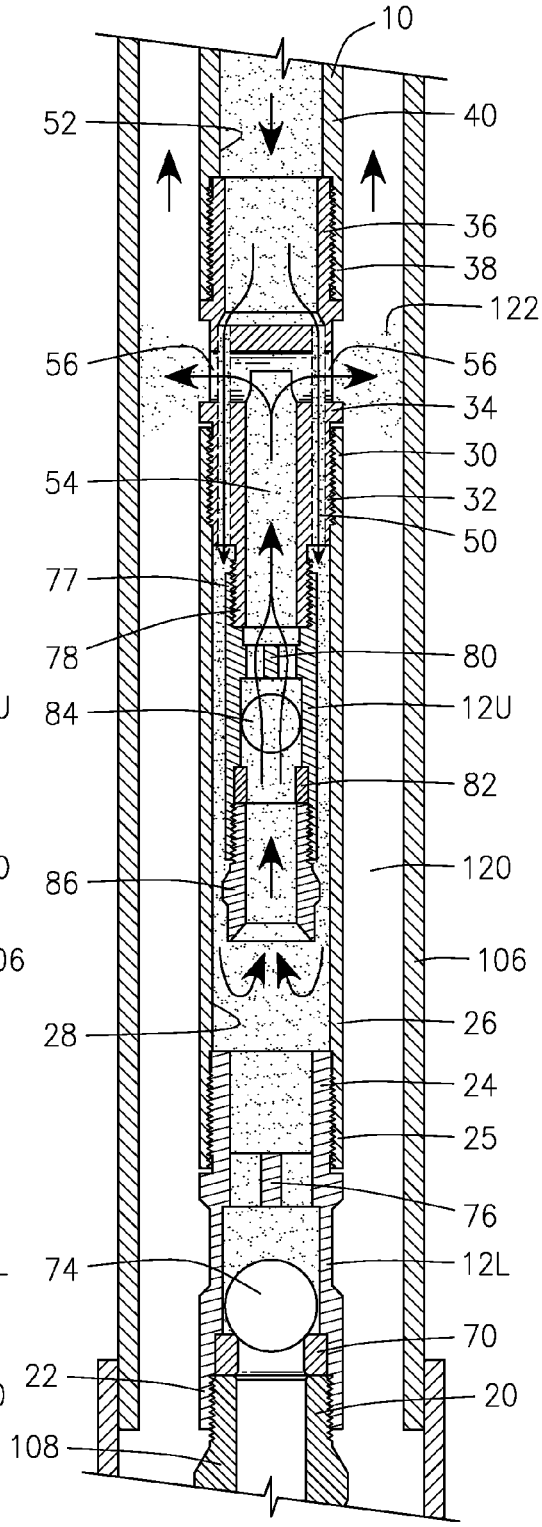
FIG. 10 is an enlarged cut away view of that portion of the pump of FIG. 8 shown within circle 10.

The flow of fluid 122 through the pump 10 will now be described in reference to FIGS. 7-10. FIGS. 7 and 9 show flow of fluid 122 associated with upstroke of the piston 60 and FIGS. 8 and 10 show flow associated with down stroke of the piston 60. The smaller arrows appearing in FIGS. 7 and 8 and all of the arrows appearing in FIGS. 9 and 10 indicate the flow path of the of fluid 122 through and in association with the pump 10.

During upstroke of the piston 60, as indicated by Arrow U in FIG. 7, the lower standing valve 12L is open and the upper standing valve 12U is closed. Thus, during upstroke of the piston 60, fluid 122 flows upward into the lower end 22 of the lower standing valve 12L via the hollow hold down 108, then up through the lower seat 72 and around the lower ball 74, then through the lower barrel cage 76 before exiting the lower standing valve 12L at its upper end 24 and entering the hollow coupling chamber 28.

The upper standing valve 12U is closed so that fluid 122 that enters the coupling chamber 28 flows around the outside of the upper standing valve 12U and passes through the peripheral channels 50 in the relief valve 34 and enters into the housing chamber 52 of the pump 10, filling the housing chamber 52 with fluid 122.

When the piston 60 has finished its upward stroke, it reverses direction and begins its downward stroke. As the piston 60 begins to move downward, as indicated by Arrow D in FIG. 7 the lower ball 74 closes on the lower seat 72, thereby closing the lower standing valve 12L. Simultaneously, the upper ball 84 is lifted off of the upper seat 82 and thereby opens the upper standing valve 12U. As the piston 60 continues to move downward, the fluid 122 contained within the housing chamber 52 flows back down through the peripheral channels 50 in the relief valve 34 and back into the coupling chamber 28. Because the lower standing valve 12L is closed, the fluid 122 reverses direction within the coupling chamber 28 and flows upward into the open end of the seat plug 86 and into the open upper standing valve 12U. The fluid 122 flows up through the upper seat 82 and around the upper ball 84, then through the upper barrel cage 80 before exiting the upper end 77 of the upper standing valve 12U and entering the central channel 54 of the relief valve 34. The central channel 54 of the relief valve 34 is in fluid communication with side openings 56 in the relief valve 34 which serve as the outlets 56 for the pump 10. The fluid 122 flows out of the side openings 56 and into the interior tubing space 120 located above the seating shoe 110 and between the rod string 116 and the tubing 106. Successive strokes of the piston 60 force more and more fluid 122 through the outlets 56 and into the interior of the tubing 106. Because the fluid 122 can only move upward, it flows to the surface of the well 114 within the tubing 106 where it is removed from the well 114.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method for pumping fluid from a well employing a double standing valve sucker rod pump comprising the following steps:

a. opening a lower stationary standing valve and closing a stationary upper standing valve provided on a double standing valve sucker rod pump that is installed in a well, b. moving a piston of the pump upward in conjunction with an upstroke of the rod string and thereby causing fluid to flow from the bottom of the well through the open stationary lower standing valve and into a coupling chamber located between the stationary lower standing valve and the upper stationary standing valve, c. closing the lower stationary standing valve and opening the upper stationary standing valve, d. moving the piston of the pump downward in conjunction with a down stroke of the rod string thereby pumping fluid from the coupling chamber through the stationary upper standing valve and out of the pump such that the fluid flows upward in the well on each downstroke of the rod string.

2. A method for pumping fluid from a well employing a double standing valve sucker rod pump according to claim 1 further comprising:

e. repeating steps a-d multiple times.

3. A method for pumping fluid from a well employing a double standing valve sucker rod pump according to claim 2 wherein in each iteration of step b fluid also flows simultaneously into a housing chamber which is in fluid communication with the coupling chamber by way of channels provided in a relief valve located between the coupling chamber and the housing chamber.

4. A method for pumping fluid from a well employing a double standing valve sucker rod pump according to claim 3 wherein in each iteration of step d fluid also flows simultaneously from the housing chamber back into the coupling chamber by way of the same channels in the relief valve through which the fluid originally entered the housing chamber.

5. A method for pumping fluid from a well employing a double standing valve sucker rod pump comprising the following steps:

a. moving upward a piston of a double standing valve sucker rod pump that is installed in a well in conjunction with an upstroke of the rod string which thereby opens a lower stationary standing valve of the double standing valve sucker rod pump and closes a stationary upper standing valve of the double standing valve sucker rod pump and causes fluid to flow from the bottom of the well through the open stationary lower standing valve and into a coupling chamber located between the stationary lower standing valve and the upper stationary standing valve, b. moving downward the piston of the double standing valve sucker rod pump in conjunction with a downstroke of the rod string which thereby closers the lower stationary standing valve of the double standing valve sucker rod pump and opens the stationary upper standing valve of the double standing valve sucker rod pump and causes fluid to flow from the coupling chamber through the stationary upper standing valve and out of the pump and upward within the well.

6. A method for pumping fluid from a well employing a double standing valve sucker rod pump according to claim 5 further comprising:

c. repeating steps a-b multiple times.

7. A method for pumping fluid from a well employing a double standing valve sucker rod pump according to claim 6 wherein in each iteration of step a fluid also flows simultaneously into a housing chamber which is in fluid communication with the coupling chamber by way of channels provided in a relief valve located between the coupling chamber and the housing chamber.

8. A method for pumping fluid from a well employing a double standing valve sucker rod pump according to claim 7 wherein in each iteration of step b fluid also flows simultaneously from the housing chamber back into the coupling chamber by way of the same channels in the relief valve through which the fluid originally entered the housing chamber.

* * * * *